US005765875A

United States Patent [19]

Rowley

[11] Patent Number: 5,765,875

[45] Date of Patent: Jun. 16, 1998

[54] IDENTIFICATION TAG SYSTEM AND KIT

[76] Inventor: Clayton W. Rowley, 532 Rowland Rd., Fairfield, Conn. 06430

[21] Appl. No.: 857,143

[22] Filed: May 15, 1997

[51] Int. Cl.[6] ..... B42D 15/00

[52] U.S. Cl. ..... 283/74; 283/117; 281/29; 281/31; 402/79

[58] Field of Search ..... 402/4, 73, 70, 402/79, 80 R; 283/74, 117; 281/29, 31

[56] References Cited

U.S. PATENT DOCUMENTS

| | | | |
|---|---|---|---|
| 450,427 | 4/1891 | Schell . | |
| 601,869 | 4/1898 | Busch | 40/10 |
| 3,921,318 | 11/1975 | Calavetta | 40/2.2 |
| 4,122,947 | 10/1978 | Falla | 206/569 |
| 4,650,219 | 3/1987 | Sigman | 283/70 |
| 4,682,431 | 7/1987 | Kowalchuk | 40/21 |
| 4,991,337 | 2/1991 | Solon | 40/633 |
| 5,380,046 | 1/1995 | Stephens | 283/75 |
| 5,423,574 | 6/1995 | Forte-Pathroff | 283/75 |
| 5,499,468 | 3/1996 | Henry | 40/633 |
| 5,501,540 | 3/1996 | Ho | 402/79 X |
| 5,634,668 | 6/1997 | Barreiro, Jr. | 402/79 X |
| 5,682,990 | 11/1997 | Schluger | 402/79 X |

*Primary Examiner*—Willmon Fridie, Jr.

*Attorney, Agent, or Firm*—Perman & Green, LLP

[57] ABSTRACT

An identification system is provided for children traveling as a group under the guidance of a teacher. Each child carries an identification tag on a frangible length of bead chain. The tag has first identifying indicia such as an unduplicated number unique to that child and second identifying indicia providing information relating to the group. The name of each child and of the group containing the child is written on an information sheet held by the teacher. A support sheet has a front side with a plurality of pocket members, each defining a device compartment for removably receiving one of the identification tags and its chain and a rear side including a pouch member coextensive with all of the pocket members and defining an information cell therein. An identification sheet is received in the information cell has a plurality of information zones, each bearing the name and biographical information relating to a child. The shape and size of the identification sheet is such that, when fully received in the pouch member, each of the information zones is positioned so as to be coextensive with an associated one of the device compartments. When the support sheets and the pocket member are transparent, the biographical information for a child can be viewed through the pocket member defining the device compartment for the identification tag of that child. A loose-leaf notebook may be used for assembling the information sheets and support sheets in a predetermined sequence.

20 Claims, 6 Drawing Sheets

FIG. 7.

SCHOOL
ADDRESS
CITY, STATE, ZIP
PHONE
TEACHER: _____
CLASS TRIP: _____
TRIP DATE: _____
CLASS SIZE: _____

| STUDENT NAME | MEDICAL ALERT ✓ | TRIP ID TAG # | STUDENT NAME | MEDICAL ALERT ✓ | TRIP ID TAG # |
|---|---|---|---|---|---|
| | | 101 | | | 121 |
| | | 102 | | | 122 |
| | | 103 | | | 123 |
| | | 104 | | | 124 |
| | | 105 | | | 125 |
| | | 106 | | | 126 |
| | | 107 | | | 127 |
| | | 108 | | | 128 |
| | | 109 | | | 129 |
| | | 110 | | | 130 |
| | | 111 | | | |
| | | 112 | | | |
| | | 113 | | | |
| | | 114 | | | |
| | | 115 | | | |
| | | 116 | | | |
| | | 117 | | | |
| | | 118 | | | |
| | | 119 | | | |
| | | 120 | | | |

64

IDENTIFICATION TAG SYSTEM AND KIT

BACKGROUND OF THE INVENTION

1. Field of the Invention

The present invention relates generally to a system enabling a responsible adult person in charge of a group of individuals to keep track of those individuals when on an excursion of some kind. While the tenor of this disclosure is directed to a teacher having charge of a group of students, the invention is not intended to be so limited. Indeed, it would have application to a variety of situations including, for example, a nurse or social worker having charge of a group of senior citizens or a group of handicapped people.

2. Description of the Prior Art

With the increases in metropolitan crime rates over recent years, including growth in the number of crimes against children, the handicapped, the elderly, and others who are less equipped to defend themselves, society has realized a heightened concern for personal safety and security. This includes situations where the individuals are traveling in groups.

It has been conventional practice for many years for individuals to carry on their persons some means of identification. While a state-issued drivers license suffices for a majority of adults, other means of identification are necessary for persons who cannot or do not operate automobiles, e.g., children, handicapped persons, and the elderly. Further, as to these groups of people, it is additionally important that other relevant information in addition to the person's identity be available to authorities in the case of an emergency, e.g.,., the name, address and telephone number of a guardian or close relative, important medical information, and the like.

While it is important in the event of an emergency that such an information card be conspicuous enough on the person to be immediately located by authorities, it is conversely important for reasons of personal security that, at other times, the personal information be shielded from public view so that the information cannot be read and used for criminal purposes against the person. This problem is particularly acute in the case of children in that, because children typically are not accustomed to carrying a wallet or other personal items, it is common practice for parents to attach an information card or carrier to the child's clothing, e.g., an identification card interlaced in a child's shoestrings.

Thus, a particular need exists for providing children and other generally defenseless persons, such as the handicapped and the elderly, with a convenient means of carrying personal information to be readily accessible to authorities in emergency situations, but which securely shields the information from general public view at other times.

In the past, there have been numerous approaches for providing the responsible overseer with an appropriate efficient system for knowing who and where their charges are with minimal distraction to the people being supervised. Some of these have been patented.

Patents disclosing identification various appliances for children who may have been separated from a party or lost include those issued to Sigman, U.S. Pat. No. 4,650,219, to Solon, U.S. Pat. No. 4,991,337, to Stephens, U.S. Pat. No. 5,380,046 and to Forte-Pathroff, U.S. Pat. No. 5,423,574. According to the Sigman disclosure, an alphanumeric marking is electronically embedded in an article of clothing unique to a child wearing it but not containing the child's name. If the child becomes lost, the police would use special scanning equipment to read the embedded marking to learn the identity and home of the child. The Solon and Forte-Pathroff patents each disclose an inexpensive disposable identification bracelet which can be readily attached to the child, then removed when no longer needed. In the latter instance, the indicia on the bracelet is capable of being scanned in order to assure proper identification. The Stephens patent is directed to a personal identification packet carried on the child's person, the packet including an information card sealed within a transparent plastic envelope to secure the card against outward view of the personal information contained on the card. In this instance, a person in authority, such as a policeman, would cut open the packet to ascertain the identity of the child.

The use of a ledger or recording book for listing items with identification devices are disclose in patents issued to Schell, U.S. Pat. No. 450,427, to Kowalchuk, U.S. Pat. No. 4,682,431 and to Henry, U.S. Pat. No. 5,499,468.

The Falla patent, U.S. Pat. No. 4,122,947 discloses a pre-packaged patient identification kit and method for assuring correlation between a patient, his specimens, and his records.

The patents to Busch, U.S. Pat. No. 601,869 and to Calavetta, U.S. Pat. No. 3,921,318 disclose examples of tags associated with an item or person.

It was with knowledge of the foregoing that the present invention has been conceived and is now reduced to practice.

SUMMARY OF THE INVENTION

The present invention relates to an identification system for children traveling as a group under the guidance of a teacher. Each child carries an identification tag on a frangible length of bead chain. The tag has first identifying indicia such as an unduplicated number unique to that child and second identifying indicia providing information relating to the group. The name of each child and of the group containing the child is written on an information sheet which contains the unduplicated number unique to each child held by the teacher. A support sheet has a front side with a plurality of pocket members, each defining a device compartment for removably receiving one of the identification tags and its chain and a rear side including a pouch member coextensive with all of the pocket members and defining an information cell therein. An identification sheet is received in the information cell and has a plurality of information zones, each bearing the name and biographical information relating to a child and possibly also a pictorial representation of the child.

The shape and size of the identification sheet is such that, when fully received in the pouch member, each of the information zones is positioned so as to be coextensive with an associated one of the device compartments. When the support sheets and the pocket members are transparent, the biographical information for a child can be viewed through the pocket member defining the device compartment for the identification tag of that child. A loose-leaf notebook may be used for assembling the information sheets and support sheets in a predetermined sequence.

The identification system kit of the invention is designed to be used for class trips or other student off site activities. Its purpose is to provide identification and enhanced safety for young children while off school grounds. Its function is to easily coordinate the exchange of information between the school, the traveling class group, the transportation system, and the visited off school site.

As envisioned, the system kit of the invention would contain two or more of each of the following items listed below. The kit size is determined utilizing an average size class of 21 to 30 children and assuming an average number of classes per grade level in the K–6 range to be three. As a result, the total number of tags in each kit would be 90.

A case as a stand alone unit would be used by each teacher and probably be carried with her or him on each trip. It would be large enough to contain a 3-ring binder holding thirty tags and other trip related items. The case has a handle and is closed on all sides to prevent anything from falling out.

A three-ring binder, preferably of standard size: 11⅞"×10"×1½", is intended to hold all the items needed for each particular trip and will be able to accommodate any of the inserts described below. It has an appearance similar to the case with respect to color, material, graphics, and the like. The inside of the binder has a front and back pocket, typically 5" deep, to hold note paper, trip planner sheets with student names and the trip identification tag number assigned to each student. It may also contain a safety sheet as a reminder for the children, a color coordinated display card depicting the identification tags in enlarged format for placement in the windows of the vehicle carrying the children, and directions for use.

Inserted into each of the binders are three 10-pocket plastic sheets provided to hold 30 tags. Flaps cover each pocket on the sheet to prevent any of the tags from failing out. The sheet is preferably 8½" wide so that tab dividers are visible between sheets. Associated with the three 10-pocket plastic sheets are three photograph sheets, also containing 10 areas designed to be used to contain a photograph of the child and personal information relating to the child. The 7" photograph and information sheet slips behind the 10-pocket plastic sheet in a specially designed information cell attached to the back of the plastic sheet. This plastic sheet with 10-pocket tag holders and a full length information cell in back is a new, unique design manufactured specifically for this identification kit.

Alternate versions of the above described binder and sheet arrangement leaves the teacher with several choices for information management. For a first choice, the teacher may use an included notepad to enter the class list of names and the tag numbers assigned to each student. According to a second choice, a second set of 10-pocket sheets may be used to place a photo and identification information into a corresponding pocket behind the assigned tag. When the teacher returns the kit for use by another class, she can retain the photograph sheets for use on the next trip. For a third choice, the teacher may use the school's computer-generated class list and enter assigned tag numbers on it. This class list would then be placed in a front or rear pocket of the binder.

Tab sheets are used to separate the sections of the notebook and, typically, five tab sheets are included.

Thirty embossed tags are typically included with each binder. Each set of 30 tags is attached to a 24" piece of Bead Chain® brand elongated material and has a generic number printed on them. For safety purposes, no tags would contain a child's name. In typical fashion, each tag might be marked as follows:

the first line reads, for example: "101", "102", "103", etc.

the second line contains the name of the school the third line contains the street address of the school the fourth line contains the city and state of the school the fifth line contains the area code and phone number of the school an alternate phone number might be used on the fifth line for contacting someone after school hours, i.e. after 5:00 p.m. when the likelihood of someone still being in the school office is reduced.

Of course, it will be appreciated that various of the lines of information can be interchanged, if desired.

Optional items may include, for example:

nine medical alert tags which may be generic or provided or embossed with specific medical conditions, allergies, medications, and special needs;

replacement 24" Bead Chain® elongated material; and replacement or spare tags in case some get lost or stolen.

It would also be desirable to provide the loose leaf binder with, for example, an 8½"×11" sheet with tag shape printed on it or large reusable tag-shaped cards or cutouts in colors corresponding to the colors of the kits to be placed in the window of the bus or other vehicle transporting the children, enabling each child to identify the vehicle.

The teacher planning a class trip has several choices for information management using the identification system kit of the invention. The binder can be taken on the trip to carry tags and all associated information or the class list/tag number information sheet and photographic log can be taken on the trip. The tags can be distributed at the site or can be distributed prior to departure. The kit notepad provided can be used to enter class names to an assigned tag number or the school's class list can be used to write in the assigned tag number. Copies of the class list/tag numbers can be given to the school administration, to the transportation company, and to the off site facility.

The use of the class photographic log is strongly recommended during a trip for its ability to provide definitive detail during an emergency situation.

Accordingly, a primary feature of the present invention is to provide a system enabling a responsible adult person in charge of a group of individuals to keep track of those individuals when on an excursion of some kind.

Another feature of the present invention is to provide such a system by the use of which all concerned parties are informed of the names of and biographical information relating to the students present on the excursion.

Still another feature of the invention is to provide a kit made available to the teacher or other responsible adult with the items necessary to accomplish the foregoing goals.

Yet another feature of the invention is to provide such a kit comprising a loose-leaf binder containing a plurality of identification devices in the form of distinctive tags adapted to be removably carried on the body of each student, each tag inscribed with first identifying indicia unique to the individual student carrying it without overtly identifying the individual, each tag inscribed with second identifying indicia providing information relating to the group with which the students are associated, an information sheet inscribed with the names of each of the students in the group in association with the first identifying indicia unique to each individual student, a support sheet having a plurality of pocket members, each defining a device compartment for removably receiving one of the tags and including a pouch member coextensive with all of the pocket members and defining an information cell, and an identification sheet imprinted with a plurality of information zones, each of the information zones bearing the name and biographical information thereon relating to a different one of the individual students, the identification sheet being selectively receivable in the information cell of the pouch member such that, when fully received therein, each of the information zones is positioned so as to be coextensive with an associated one of the device compartments.

Still a further feature of the invention is to provide such a kit which is color-coded such that the notebook and the identification tags have a predetermined color, wherein each of the identification tags has a distinctive shape, and including at least one card of the predetermined color having a size generally similar to that of the notebook and generally of the shape of the identification tags for placement in the window of a vehicle used for carrying the individuals.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

BRIEF DESCRIPTION OF THE DRAWINGS

FIG. 7 is a plan view of an information sheet which is another component of the invention;

DETAILED DESCRIPTION OF THE PREFERRED EMBODIMENTS

Figure 1:
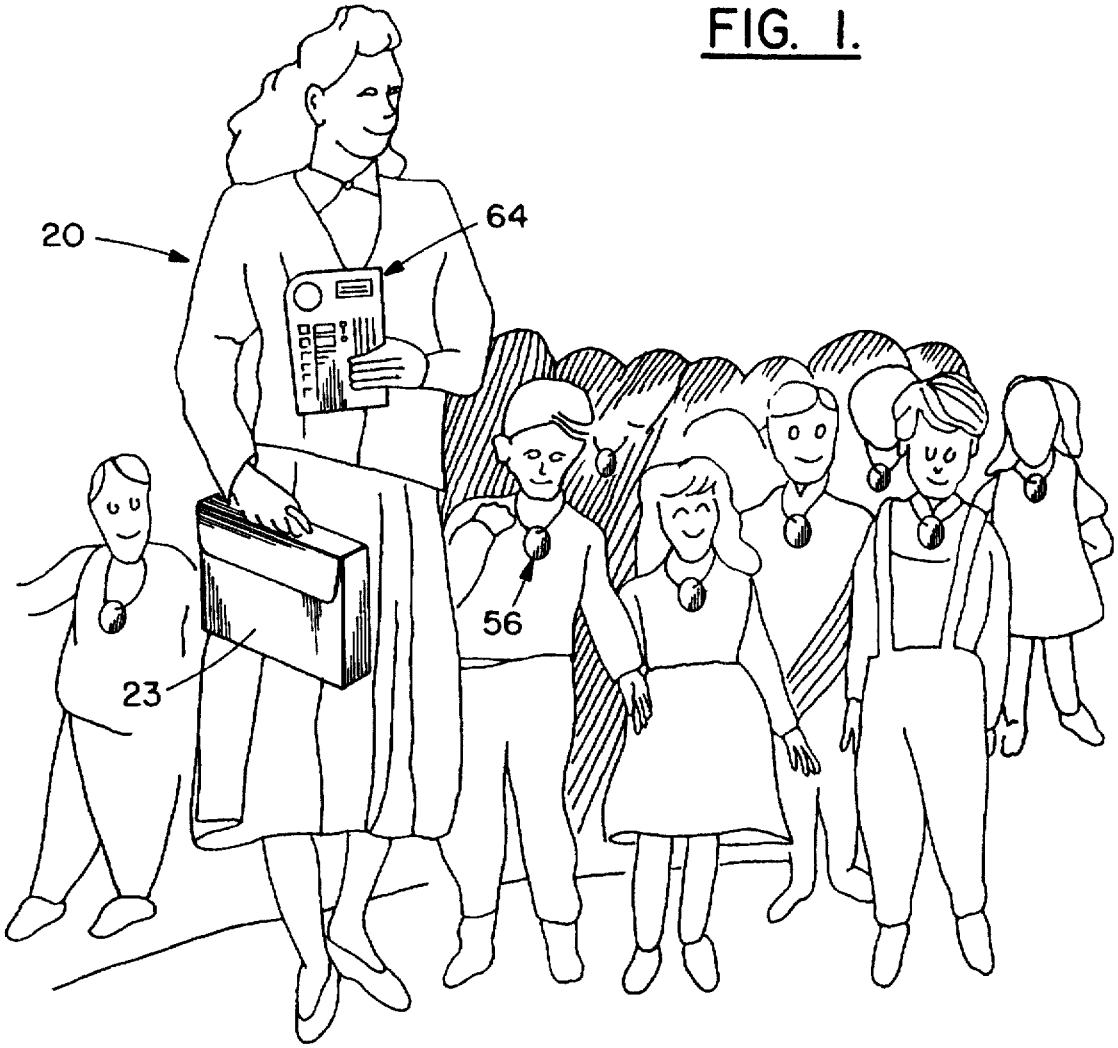
FIG. 1 is a pictorial representation of the system and kit of the invention in operation.
Figure 2:
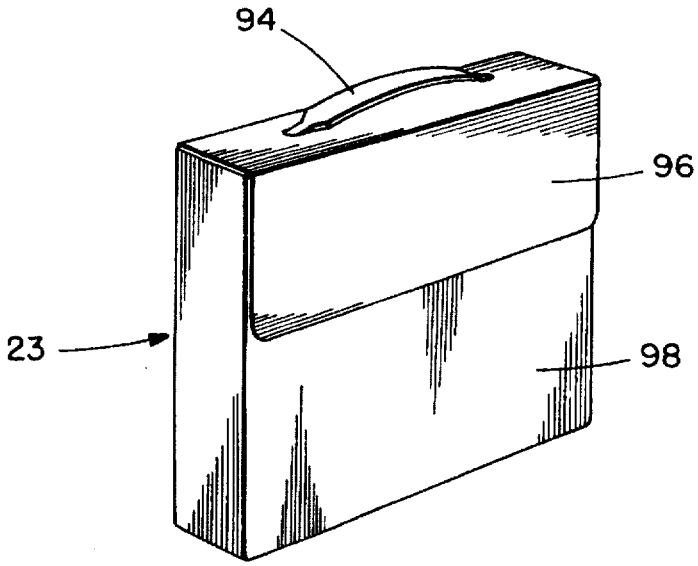
FIG. 2 is perspective view of a case which, together with its contents, embodies the invention.
Figure 3:
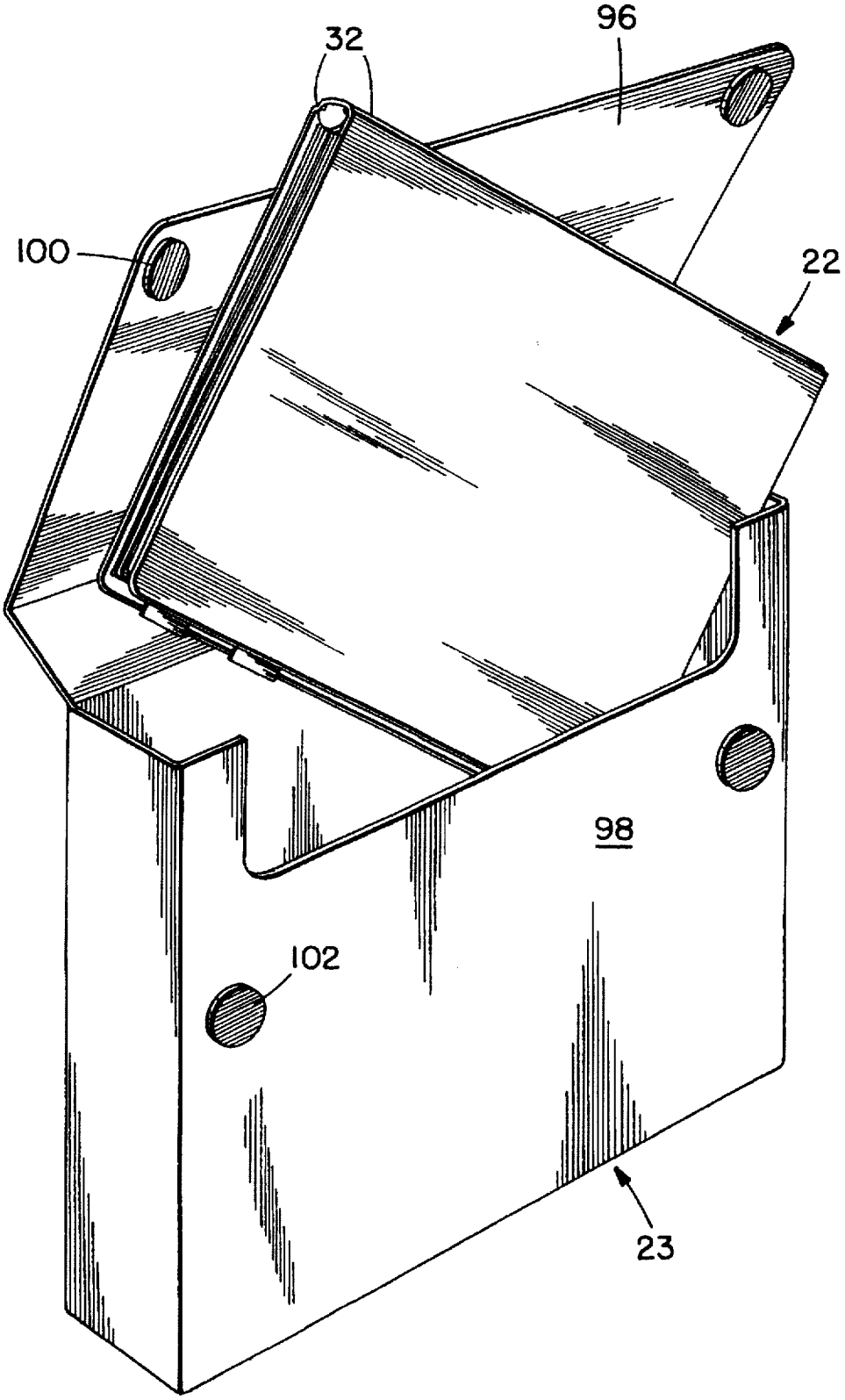
FIG. 3 is a perspective view of the kit embodying the invention.

Turn now to the drawings and, initially, to FIGS. 1–4 which generally illustrate an identification system 20 for individuals traveling as a group. As previously noted, the system may be used in connection with school children or with various other categories of people such as, but not limited to, senior citizens or handicapped people.

The system includes a holding member in the form of a loose-leaf notebook 22 for assembling a plurality of items in a predetermined sequence as will be described. Additionally, a case 23 of semi-rigid material may be employed for protectively receiving and enclosing the loose leaf notebook 22 with its plurality of items therein.

In a customary fashion, the loose leaf notebook 22 includes front and rear covers 24, 26, respectively, and a spine 28 having a plurality of spaced binder rings 30 selectively movable between open and closed positions and hinges 32 pivotally joining the front and rear covers for movement between an in-use position (FIG. 4) for exposing the binder rings and an at-rest position (FIG. 3) for concealing the binder rings.

Figure 4:
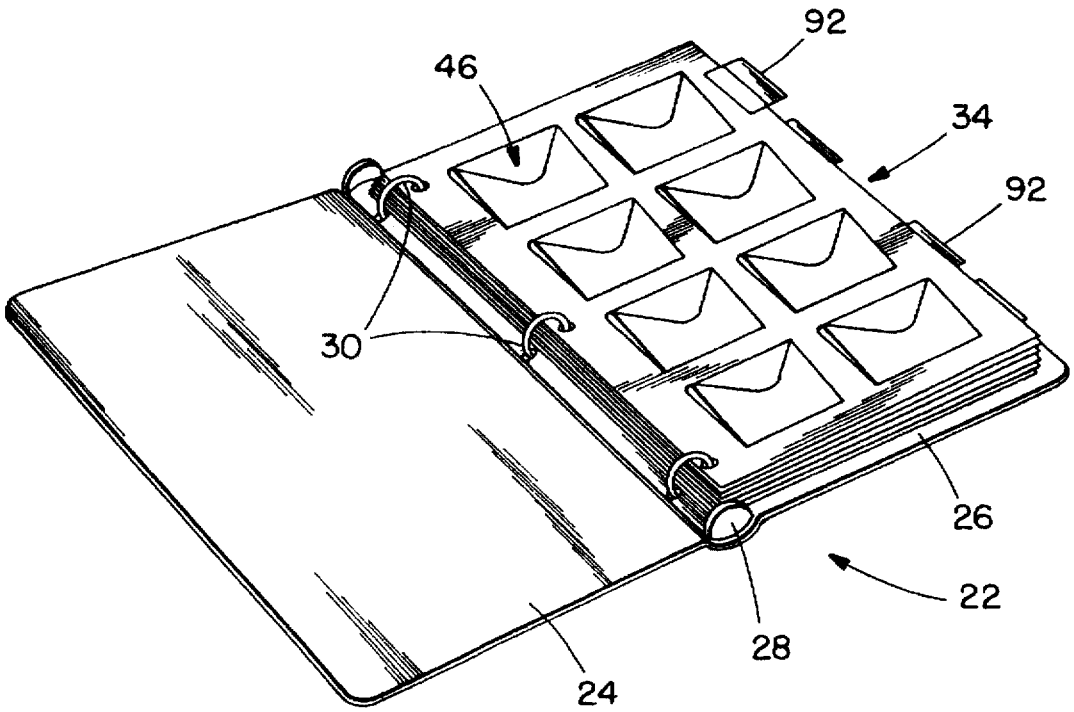
FIG. 4 is a perspective view of a loose-leaf notebook containing various components comprising the kit of the invention.
Figure 5A:
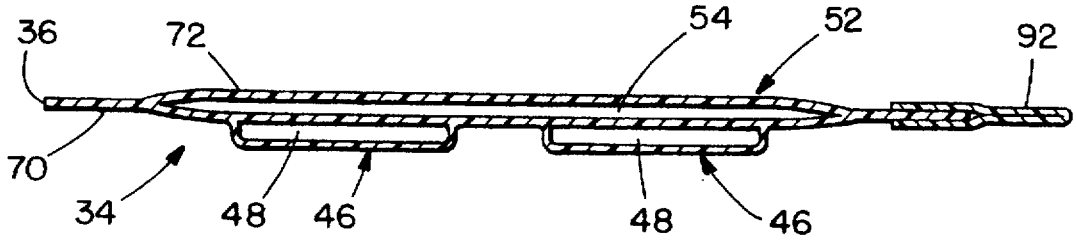
FIG. 5A is a cross section view taken generally along line 5A—5A in FIG. 5.
Figure 5:
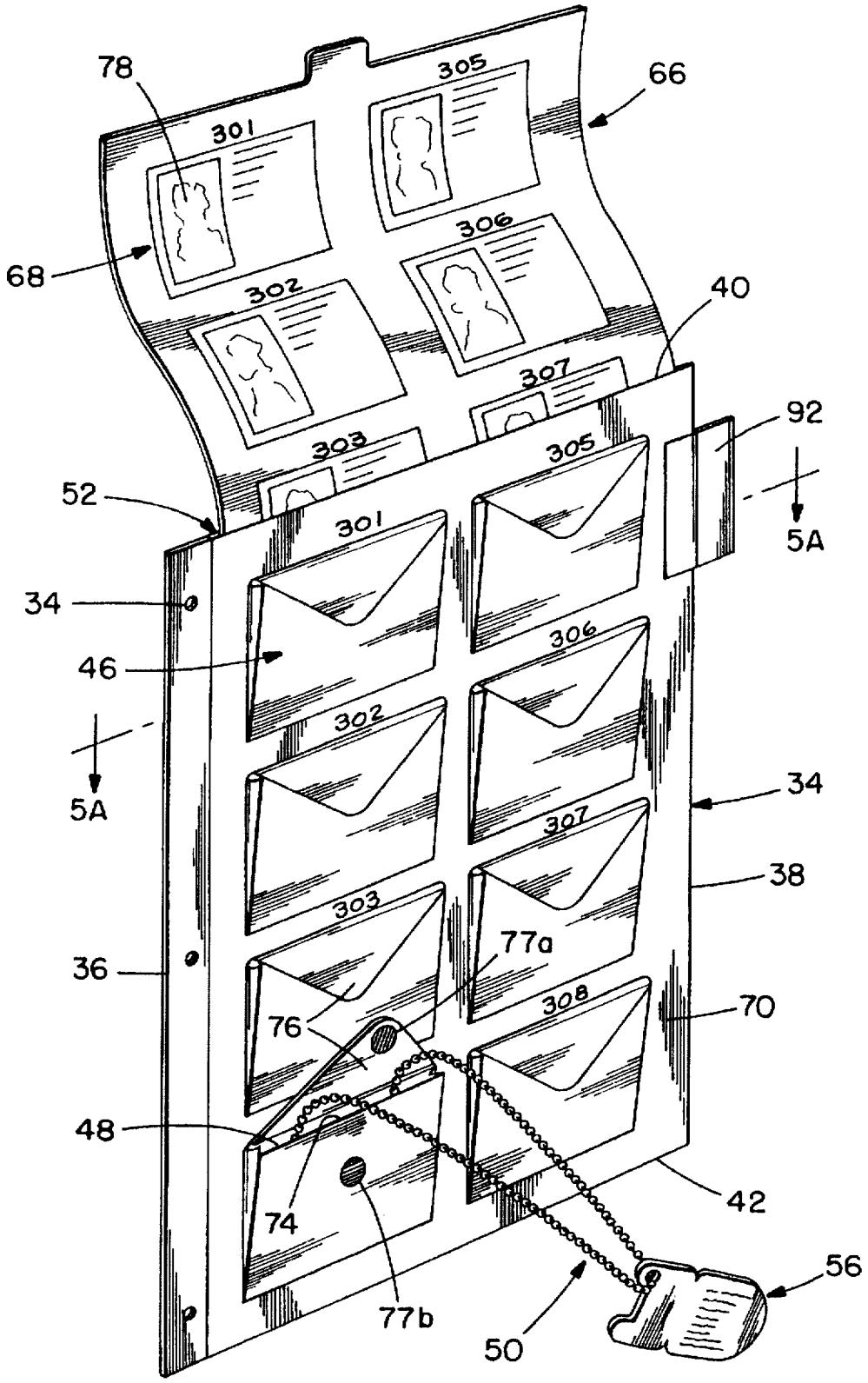
FIG. 5 is a perspective view illustrating various components comprising the kit of the invention.

Included among the items intended to be carried by the loose-leaf notebook 22 are support sheets 34 (FIGS. 4 and 5). Each support sheet 34, preferably composed of vinyl or other durable transparent plastic material, is defined by a pair of spaced apart parallel longitudinally extending edges 36, 38 and a pair of spaced apart parallel laterally extending edges 40, 42 and has a plurality of mounting holes 44 adjacent the longitudinally extending edge 36 aligned for removable reception onto the binder rings 30 in the customary manner. Each support sheet 34 also has a plurality of integral pocket members 46, each defining a device compartment 48 (FIG. 5) for removably receiving one of a plurality of identification devices 50, to be described, and including a pouch member 52 (FIGS. 5 and 5A) coextensive with all of the pocket members and defining an information cell 54 therein.

Figure 6:
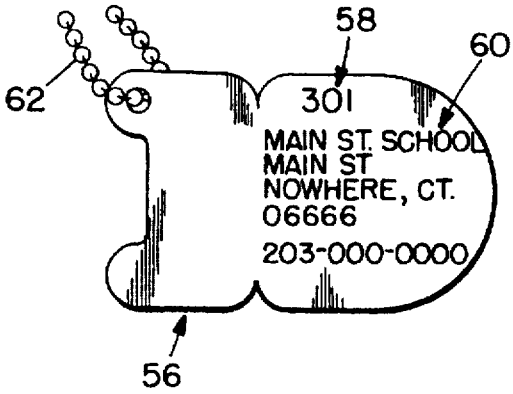
FIG. 6 is a detail plan view illustrating primarily an identification tag as one component of the invention.

The system 20 also includes a plurality of the identification devices 50, each of which is adapted to be removably carried on the body of an individual. Each of the identification devices 50 includes an identification tag 56 (FIG. 6) inscribed with first and second identifying indicia 58, 60, respectively, and a suitable attachment appliance such as an elongated member 62 connected to the identification tag. The elongated member may be of a variety of suitable materials including string, ribbon and chain, but a preferred construction is manufactured by Bead Industries of Bridgeport, Conn. under the registered trademark Bead Chain®. While it is highly desirable to provide identification devices 50 for the purposes already mentioned, they must not be used in a manner which is adverse to the individual wearing it. It must be recognized that an individual wearing an identification device 50 including an elongated member 62 is subject to the intentional or unintentional manipulation of the elongated member by third parties which could result in serious injury to the individual. The elongated member 62, then, is preferably a looped strand of a material or construction which is adapted to fracture when subjected to a tensile force greater than a predetermined value.

The following chart relates the results of tensile tests of various materials used to suspend items about the neck. The tests were performed under the direction of the inventor on samples using a chatillion tensile tester with a speed of approximately one inch per minute. Results are presented in pounds weight.

| Material | Single Strand |
|---|---|
| Shoelace String, no wax | 22.5 |
| Shoelace String, waxed | 44.5 |
| Sneaker shoelace (61 cm.) | 61.5 |
| Balloon Ribbon (¾") | 27 |
| Dbl. Face Satin Ribbon (⅛") | 22.5 |
| 100% Polyester Ribbon (¾") | 47 |
| Dbl. Face Satin Ribbon (⅜") | 66.5 |
| #3 NP BR Chain | 20.5 |

The "#3 NP BR Chain" indicated above is, in fact, Bead Chain® brand nickel plated brass chain of #3 size bead which, in a single strand configuration, will fracture when subjected to a tensile load in excess of approximately 20 pounds. Hence, it is clear that Bead Chain® brand material is elongate material particularly desirable for the purpose of the invention. While it is durable and attractive, it yields when subjected to less tensile force than that which would be injurious to an individual. It is generally considered that elongated material which would fracture if subjected to greater 20 pounds of tensile force could be injurious to an individual.

The identification tags 56 may be composed of sheet metal or plastic or other durable material and have a distinctive shape or outline, as illustrated. Each identification tag is imprinted with the first identifying indicia 58 unique to the individual on whom it is carried without overtly identifying the individual and the second identifying indicia 60 providing information relating to the group with which the group of individuals is associated.

The system 20 also includes an information sheet 64 (FIG. 7) for selective reception thereon of the names of each of the individuals of the group in association with the first identifying indicia 58 unique to that individual. This sheet may be held by a responsible adult person (see FIG. 1) separate from the other items comprising the system 20.

Also intended for placement in the loose-leaf notebook 22 is an identification sheet 66 (FIG. 5) having a plurality of information zones 68, each of the information zones inscribed with the name and biographical information thereon relating to a different one of the individuals. The identification sheet 66 is selectively receivable in the information cell 54 of the pouch member 52 such that, when fully received therein, each of the information zones is positioned so as to be coextensive with an associated one of the device compartments 48.

Each of the support sheets 34 has a front side 70 and a rear side 72. The pocket members 46 defining the device compartments 48 are positioned on the front side of each of the support sheets and the pouch member 52 defining the information cell 54 is positioned on the rear side of each of the support sheets. As noted earlier, at least the support sheets 34 and the pocket members 46 are transparent such that the biographical information for each individual can be viewed through the pocket member defining the device compartment for the identification device of that individual. Each of the pocket members 46 has an upwardly facing opening 74 (FIG. 5) through which the identification devices 50 may be inserted and removed and a flap member 76 overlying the opening but movable to allow entry through the opening into the device compartment. A hook and loop fastener as indicated by pads 77*a* and 77*b* may be provided for selective closure of a flap.

Figure 8:
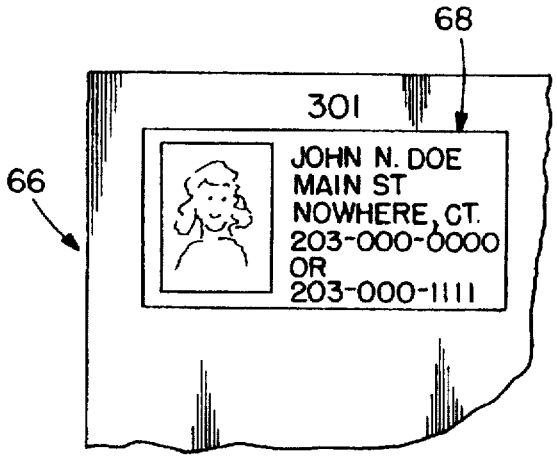
FIG. 8 is a detail view of a portion of another embodiment of the identification sheet of FIG. 5.
Figure 9:
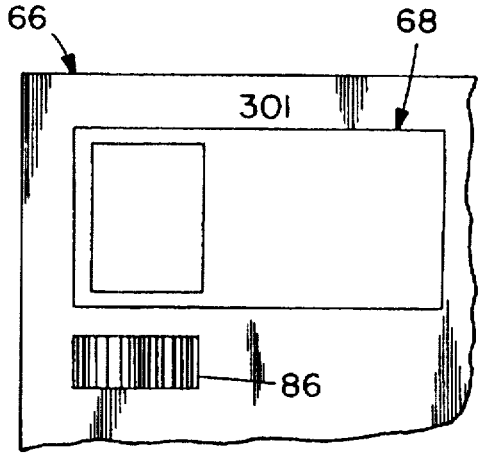
FIG. 9 is a detail view of a portion of still another embodiment of the identification sheet of FIG. 5.
Figure 10:
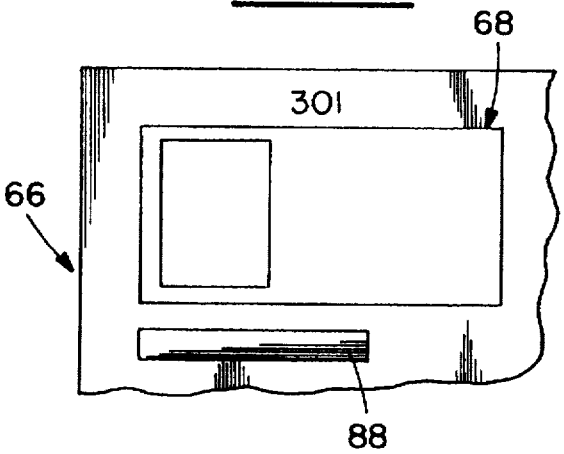
FIG. 10 is a detail view of a portion of yet another embodiment of the identification sheet of FIG. 5.

Each identification sheet 66 may include a pictorial representation 78 (FIGS. 5 and 8) of the individual to which it pertains. Also, each identification sheet may include a machine readable trace bearing the name and biographical information thereon relating to a different one of the individuals. In one instance, viewing FIG. 9, the machine readable trace may include a bar code marking 86 and, in another instance, viewing FIG. 10, the machine readable trace may include a magnetic strip 88.

The identification system 20 may be practiced in such a way that at least one of the case 23, the notebook 22, and the identification tags 56 has a predetermined color.

Figure 11:
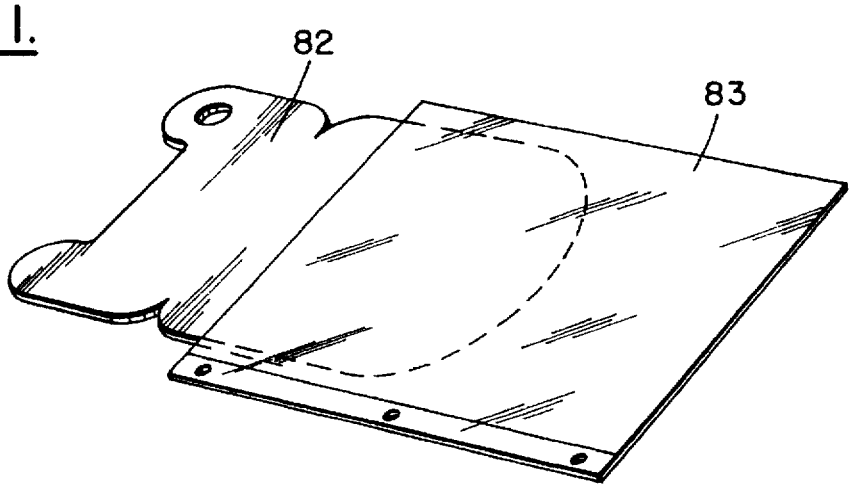
FIG. 11 is a detail perspective view of an optional component of the kit of the invention.

Further, it was earlier explained that, preferably, each of the identification tags 56 has a distinctive shape. In this configuration it would be desirable for the system to include at least one display card 82 (FIG. 11) displaying the predetermined color having a size generally similar to that of the loose-leaf notebook 22 and generally of the shape or outline of the identification tags for placement in the window of a vehicle used for carrying the individuals. The display card 82 is preferably of durable sheet material, typically, cardstock, cardboard, plastic, or the like and may be protectively retained, if desired, when not in use or if not subsequently discarded, in a carrier sleeve 83 which is also releasably received on the binder rings 30 of the loose-leaf notebook 22. One or more of the display cards 82 may be placed in the windows of the vehicle carrying the group of individuals thereby improving the ease with which an individual can locate his or her appropriate vehicle.

Figure 12:
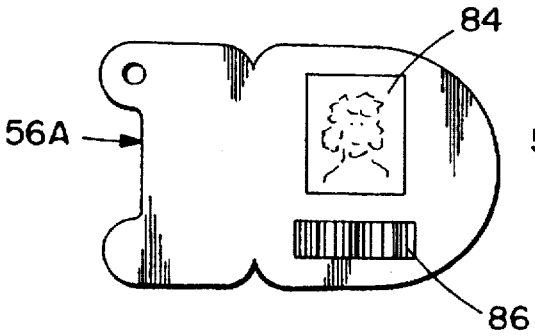
FIG. 12 is a detail plan view of another embodiment of the identification tag of FIG. 6.
Figure 13:
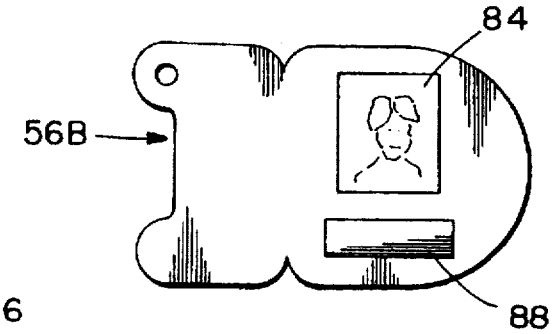
FIG. 13 is a detail plan view of still another embodiment of the identification tag of FIG. 6.

In a manner similar to that employed by the identification sheet 66, the identification system 20 may use identification tags which include a pictorial representation 84 of the individual. In a similar fashion, each identification tag may also include a machine readable trace bearing the name and biographical information thereon relating to a different one of the individuals. In one instance, viewing FIG. 12, a modified identification tag 56A is inscribed with a machine readable trace in the form of a bar code marking 86 and, in another instance, viewing FIG. 13, another modified identification tag 56B is inscribed with a machine readable trace in the form of a magnetic strip 88.

To complete the description of the identification system 20, a plurality of divider sheets may be provided for separating successive pairs of the support sheets 34 and identification sheets 66. Each of the divider sheets includes a tab member 92 which projects outwardly from the outer edges of the support sheets 34 and identification sheets 66 and the tab members are inscribed with information relating to the identification devices 50 associated with the support sheets. Of course, such tab members may also be provided on the support sheets 34 and identification sheets 66. Additionally, the case 23 may be provided with a handle 94 and a front flap 96 may be sealed onto a front panel 98 by suitable mating pads 100, 102, respectively, of hook and loop fastening material.

The operation of the system 20 will now be described.

The person in charge of a group completes the necessary information on the information sheet 66, then distributes the identification tags 56 to the individuals in the group. The group member's names are written next to the correct number of their respective tags 66, then on the information sheet. The information sheet is a record of the first and second identifying indicia 58,60. The information sheet is photocopied and a copy given to the group's organization. Copies could also be given to authorize representatives of the transportation company which owns the vehicles transporting the individuals and of the visited site. The identification card 82 which is a transportation vehicle identifier should be attached to the vehicle window.

To use the kit of the system 20 with the identification sheet 66, the identification sheets 66 must be completed with the appropriate information. At the time of an outing, the identification sheets 66 are slipped into the information cell 54 in the rear side of the support sheet 54. The identification tags are distributed so that the person whose information zone 68 is positioned under a particular tag receives that tag. The identification system in its case would accompany the group on the outing for purposes of providing personal information identification if needed. The information sheet 64 is completed and the steps mentioned in the previous paragraph followed.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. An identification system for individuals traveling as a group, said system comprising:

a plurality of identification devices, each of said identification devices adapted to be removably carried on the body of an individual and having first identifying indicia unique to the individual on whom it is carried without overtly identifying the individual, each of said identification devices having second identifying indicia providing information relating to the group with which the individuals are associated;

an information sheet for selective reception thereon of the names of each of the individuals of the group in association with said first identifying indicia unique to that individual;

a support sheet having a plurality of pocket members, each defining a device compartment for removably receiving one of said plurality of identification devices and including a pouch member coextensive with all of said pocket members and defining an information cell therein; and an identification sheet having a plurality of information zones, each of said information zones bearing the name and biographical information thereon relating to a different one of the individuals, said identification sheet being selectively receivable in the information cell of said pouch member such that, when fully received therein, each of said information zones is positioned so as to be coextensive with an associated one of the device compartments.

2. An identification system as set forth in claim 1 including:

a holding member for assembling at least one of said information sheets and a plurality of said support sheets in a predetermined sequence.

3. An identification system as set forth in claim 2 wherein said holding member includes a loose leaf notebook including front and rear covers and a spine having a plurality of spaced binder rings selectively movable between open and closed positions and hinge means pivotally joining said front and rear covers for movement between an in-use position for exposing said binder rings and an at-rest position for concealing said binder rings; and wherein each of said support sheets includes a pair of spaced apart parallel longitudinally extending edges and a pair of spaced apart parallel laterally extending edges and has a plurality of mounting holes adjacent one of said longitudinally extending edges aligned for removable reception onto said binder rings.

4. An identification system as set forth in claim 1 wherein each of said support sheets has a front side and a rear side;

wherein said pocket members defining the device compartments are positioned on the front side of each of said support sheets;

wherein said pouch member defining the information cell is positioned on the rear side of each of said support sheets; and wherein at least said support sheets and said pocket members are transparent whereby said biographical information for each individual can be viewed through said pocket member defining the device compartment for said identification device of that individual.

5. An identification system as set forth in claim 1 wherein each of said identification devices includes an identification tag bearing said first and second identifying indicia thereon and attachment means for appending said tag to the associated individual.

6. An identification system as set forth in claim 5 wherein said attachment means includes an elongated member connected to said identification tag.

7. An identification system as set forth in claim 6 wherein said elongated member is bead chain adapted to fracture when subjected to a tensile force greater than a predetermined value.

8. An identification system as set forth in claim 1 wherein each of said pocket members has an upwardly facing opening through which said identification devices may be inserted and removed and a flap member overlying the opening but movable to allow entry through the opening into the device compartment.

9. An identification system as set forth in claim 1 wherein said identification sheet includes a pictorial representation of the individual.

10. An identification system as set forth in claim 1 wherein said identification sheet includes a machine readable trace bearing the name and biographical information thereon relating to a different one of the individuals.

11. An identification system as set forth in claim 10 wherein said machine readable trace includes a bar code marking.

12. An identification system as set forth in claim 10 wherein said machine readable trace includes a magnetic strip.

13. An identification system as set forth in claim 3 including:

a plurality of said support sheets;

a plurality of said information sheets, one of said information sheets being received in the information cell of each of said support sheets;

a plurality of said identification sheets; and a case of semi-rigid material for protectively receiving and enclosing said loose leaf notebook with said support sheets and said information sheets therein and for protectively receiving and enclosing said identification sheets therein.

14. An identification system as set forth in claim 13 wherein at least one of said case, said notebook, and said identification tags has a predetermined color;

wherein each of said identification tags has a distinctive shape; and wherein said system includes at least one card of the predetermined color having a size generally similar to that of said loose-leaf notebook and generally of the shape of said identification tags for placement in the window of a vehicle used for carrying the individuals.

15. An identification system as set forth in claim 5 wherein each of said identification tags includes a pictorial representation of the individual.

16. An identification system as set forth in claim 5 wherein each of said identification tags bears thereon the name and biographical information thereon relating to a different one of the individuals.

17. An identification system as set forth in claim 1 wherein each of said identification tags includes a machine readable trace bearing the name and biographical information thereon relating to a different one of the individuals.

18. An identification system as set forth in claim 17 wherein said machine readable trace includes a bar code marking.

19. An identification system as set forth in claim 17 wherein said machine readable trace includes a magnetic strip.

20. An identification system as set forth in claim 3 including:

a plurality of divider sheets for separating successive pairs of said support sheets, each of said divider sheets including a pair of spaced apart parallel longitudinally extending inner and outer edges and a pair of spaced apart parallel laterally extending upper and lower edges and having a plurality of mounting holes adjacent said inner edge aligned for removable reception onto said binder rings; and a tab member on each of said divider sheets projecting outwardly from said outer edges in a direction away from said inner edges, said tab members bearing information thereon relating to said identification devices associated with said support sheets.

* * * * *